US005225820A

United States Patent [19]

Clerc

[11] Patent Number: 5,225,820

[45] Date of Patent: Jul. 6, 1993

[54] MICROTIP TRICHROMATIC FLUORESCENT SCREEN

[75] Inventor: Jean-Frédéric Clerc, Tokyo, Japan

[73] Assignee: Commissariat a l'Energie Atomique, Paris, France

[21] Appl. No.: 829,612

[22] Filed: Jan. 30, 1992

Related U.S. Application Data

[63] Continuation of Ser. No. 371,285, Jun. 23, 1989, abandoned.

[30] Foreign Application Priority Data

Jun. 29, 1988 [FR] France ..... 88-0754

[51] Int. Cl.[5] ..... G09G 3/20

[52] U.S. Cl. ..... 340/752; 340/766

[58] Field of Search ..... 340/752, 784, 781, 766, 340/782; 313/309, 495, 496, 497, 409

[56] References Cited

U.S. PATENT DOCUMENTS

| | | | |
|---|---|---|---|
| 4,575,765 | 3/1986 | Hirt | 340/781 |
| 4,736,198 | 4/1988 | Tokuyama et al. | 340/702 |
| 4,763,187 | 8/1988 | Biberian | 340/775 |

FOREIGN PATENT DOCUMENTS

| | | |
|---|---|---|
| 0155895 | 9/1985 | European Pat. Off. . |
| 0172089 | 2/1986 | European Pat. Off. . |
| 3036219 | 5/1982 | Fed. Rep. of Germany . |
| 2536889 | 6/1984 | France . |

OTHER PUBLICATIONS

"Flat Panel Displays and CRTS" 1985 Lawrence E. Tannas, Jr. pp. 21-22.

*Primary Examiner*—Ulysses Weldon
*Assistant Examiner*—Doom Yue Chow
*Attorney, Agent, or Firm*—Michael N. Meller

[57] ABSTRACT

A microdot trichromatic fluorescent screen comprising two facing substrates. The first substrate supports cathode conductors provided with microdots, grids and an insulating layer separating the same. The second substrate supports three series of parallel conductive bands. The conductive bands of each series are electrically interconnected and covered with a material luminescing in one of the three primary colors red, green and blue. Each series of conductive bands corresponds to a red, green or blue anode. The production of this screen requires no positioning between the two substrates.

7 Claims, 5 Drawing Sheets

FIG. 4A
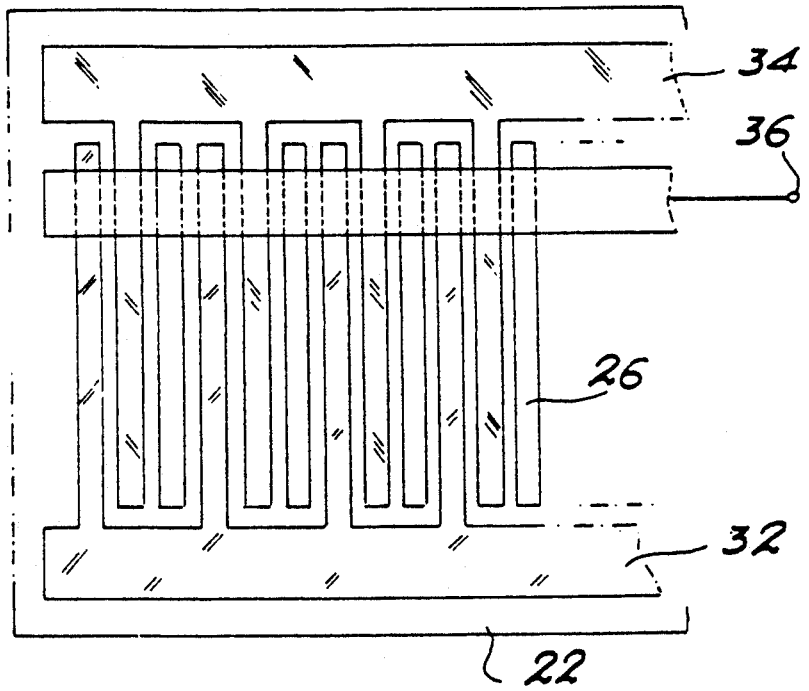
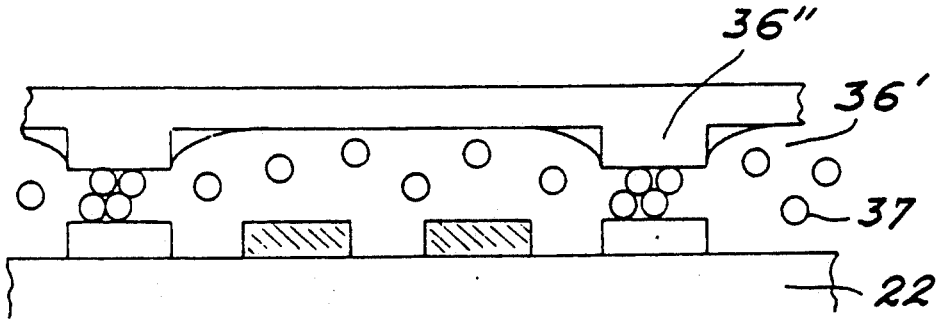
FIG. 4B

VA1
VA1 MAX
VA1 MIN

VA2
VA2 MAX
VA2 MIN

VA3
VA3 MAX
VA3 MIN

VGi
VG MAX
VG MIN
FIG. 7E C1
VCj
tG1
tG2
tG3
VC MAX
VC MIN
FIG. 7F C2
VCj
VC MAX
VC MIN
FIG. 7G C3
VCj
VC MAX
VC MIN
t1
t2
t3
T

VA1
VA1 MAX
VA1 MIN

VA2
θ1
VA2 MAX
VA2 MIN

VA3
θ2
VA3 MAX
VA3 MIN

VGi
θ3
VG MAX
VG MIN

VCj
t
VC MAX
C4
VC MIN

VCj
VC MAX
C5
VC MIN

VCj
VC MAX
C6
VC MIN
T

MICROTIP TRICHROMATIC FLUORESCENT SCREEN

This application is a continuation of application Ser. No. 371,285, filed Jun. 23, 1989, now abandoned.

DESCRIPTION

The present invention relates to a microtip trichromatic fluorescent screen, its addressing process and its production process. This type of screen is more particularly used in the color display of fixed or moving images or pictures.

The known microtip fluorescent are monochromatic, a description being provided in the report of the "Japanese Display 86 Congress", p. 512 or in French patent application 84 11986 of Jul. 27, 1984. The procedure used for monochromatic screens can be extrapolated to trichromatic screens.

FIG. 1 diagrammatically shows in perspective a trichromatic screen which could be extrapolated from a monochromatic screen. On a first e.g. glass substrate 10 are arranged conductive columns 12 (cathode conductors) supporting metal microdots 14. The columns intersect perforated conductive rows 16 (grids).

All the microtips 14 positioned at an intersection of a row and a column have their apex substantially facing a perforation of the row. Cathode conductors 12 and grids 16 are separated by a e.g. silica insulating layer 18, which has openings or apertures permitting the passage of the microtips 14.

A layer 20 of conductive material (anode) is deposited on a second transparent, e.g. glass substrate 22. Parallel bands 24 alternately in red, green and blue phosphor are deposited on the anode 20 facing the cathode conductors 12. The bands can be replaced by a mosaic pattern.

In this configuration, it is necessary to have a triplet of cathode conductors 12 (one facing a red band, another facing a green band and another facing a blue band) in order to ensure a color display along a column of the screen.

Each intersection of a grid 16 and a cathode conductor 12 in this embodiment corresponds to a monochromatic pixel. A "color" pixel is formed by three red, green and blue monochromatic pixels. The association of these three primary colors (red, green and blue) enables the eye to reconstitute a wide colored spectrum.

A matrix screen having e.g. 575 rows and 720 columns (French television standard) corresponds to a microtip fluorescent screen with 575 grids and $720 \times 3 = 2160$ cathode conductors.

FIG. 2 diagrammatically shows a section of a trichromatic screen extrapolated from a monochromatic screen. The first substrate 10 and second substrate 22 are bonded with the aid of a fusible glass joint 25 in order to form a cell, which is under a vacuum for a satisfactory operation of the screen.

FIG. 2 shows the cathode conductors 12 separated from the grids 16 by an insulating layer 18. The cathode conductors 12 face red, green and blue phosphor bands 24, the microtips not being shown.

The width L of a cathode conductor and the facing band 24 is approximately 100 micrometers. The distance D separating two cathode conductors 12 (and therefore two bands 24) is approximately 50 micrometers. The distance G between the cathode conductors 12 and the anode 20 is approximately 150 micrometers (the latter distance corresponding roughly to the thickness of the cement joint 25 located between the two substrates).

The two substrates 10 and 22 are sealed hot (at a temperature of approximately 400° C) by melting and crushing a fusible glass rod.

In order to ensure satisfactory operation, a precise positioning in facing manner of the parallel red, green and blue phosphor bands 24 and the cathode conductors 12 associated therewith is necessary. In practice, the maintaining of the positioning of the two substrates 10, 12 facing one another is very difficult during sealing. As the G/D ratio increases, this difficulty becomes more marked.

A similar problem has been solved for liquid crystal colour display cells. However, in the case of the latter, the equivalent thickness G between the two substrates is only 5 micrometers (instead of 150 micrometers for the microtip screen) for the same resolution of the patterns and the same required positioning precision. In addition, sealing takes place at low temperature by cement joints hardened by UV light irradiation following positioning and prior to the stoving of the seal. The use of this type of bond or cement is not possible in the case of microtip screens. Thus, the cements give off vapors, which would break the vacuum of the cell. It is not possible to carry out positioning prior to the hardening of the cement due to the high temperature necessary for melting and crushing the fusible or meltable glass.

As compared with a microtip monochromatic fluorescent screen, for a trichromatic screen the number of cathode conductors is multiplied by three. Additional costs result from the increased number of addressing circuits of the cathode conductors.

The present invention makes it possible to produce a microtip trichromatic fluorescent screen not requiring a precise positioning between two substrates 10,22. Moreover, the invention makes it possible to reduce the number of control circuits (which is divided by three) of the cathode conductors by only adding three additional addressing circuits for the anode electrodes.

The invention recommends the use of three anodes (one for red, one for green and the other for blue). At a given instant, one of these anodes only is raised to a sufficiently high potential to attract the electrons emitted by the microtips. The two other anodes are raised to a potential such that the electrons emitted are repelled.

In an apparatus according to the invention, the arrangement on the substrate 10 of cathode conductors 12, grids 16 and the interposed insulant 18 is the same as for monochromatic screens.

More specifically, the present invention relates to a microtip trichromatic fluorescent screen having a first substrate on which are arranged in the two directions of the matrix conductive columns (cathode conductors) supporting the microtips and above the columns perforated conductive rows (grids), the rows and columns being separated by an insulating layer having apertures permitting the passage of the microtips, each intersection of a row and a column corresponding to a pixel.

On a second substrate facing the first, said screen has regularly spaced, parallel conductive bands, which are alternately covered by a material luminescing in the red (these bands forming a so-called red anode), a material luminescing in the green (these bands forming a so-called green anode) and a material luminescing in the blue (these bands forming a so-called blue anode), the conductive bands covered by the same luminescent material being electrically interconnected.

This arrangement of three anodes in a comb-like configuration on the second substrate makes it possible to overcome any positioning problem. For example, the conductive bands of the anodes are placed substantially in the same direction as the cathode conductors, three successive red, green and blue bands advantageously facing a cathode conductor.

The conductive bands can obviously assume any direction with respect to that of the cathode conductors. Moreover, the number of conductive bands is independent of the number of cathode conductors. Preferably, the number of conductive bands is greater than three times the number of cathode conductors in order to ensure a better visual fusion of the color.

The present invention also relates to a process for addressing a microtip trichromatic fluorescent screen. This process consists of successively raising the anodes Ai, i ranging from 1 to 3, periodically to a potential VAimax adequate for attracting the electrons emitted by the microtips of the cathode conductors corresponding to the pixels which are to be "illuminated/switched on" in the color of the considered anode Ai. When they are not raised to the potential VAimax, the anodes Ai are raised to a potential VAimin, such that the electrons emitted by the microtips are repelled or have an energy below the threshold cathodoluminescence energy of the luminescent materials covering the anodes Ai.

In a first preferred embodiment, the display of a trichromatic field or frame of the image takes place during a frame time T, the anodes Ai being raised to the potential VAimax for a period equal to the frame time T, the latter being divided into three times t1, t2 and t3 corresponding to the times during which the anodes A1, A2 and A3 are raised to the potentials VA1max, VA2max and VA3max.

In a second preferred embodiment, the display of a trichromatic frame of the image takes place by sequentially addressing each row of the grid conductor for a selection time t, the anodes Ai being raised to the potential VAimax for a period equal to the selection time t, the latter being divided into three periods $\theta 1$, $\theta 2$ and $\theta 3$ corresponding to the times during which the anodes A1, A2 and A3 are raised to the potentials VA1max, VA2max and VA3max.

In these embodiments of the process, the three colors are never displayed at the same time. The color sensation on a broad spectrum perceived by an observer of the screen is due to a reconstitution of the colored spectrum by the viewer's eye. The eye is a "slow" detector compared with the screen frame time and the perception of the full color is due to an averaging effect over several frames of the image or picture.

The present invention also relates to a process for the production of a microtip trichromatic fluorescent screen. This production process comprises covering the second substrate with a conductive material, etching in said material regularly spaced, parallel bands, which are alternately grouped into three series, a first series of said bands being electrically connected by a first conductive material connection band, the latter being perpendicular to the parallel bands and placed at one of the ends thereof, a second series of said parallel bands being electrically connected by a second conductive material connection band, the latter being perpendicular to the parallel bands and placed at the other end thereof, electrically interconnecting the third series of parallel bands by an anisotropic conductive ribbon or tape and covering a first series of parallel bands by a material able to emit luminescence in the red, a second series of parallel bands by a material able to emit luminescence in the blue and a third series of parallel bands by a material able to emit luminescence in the green.

The conductive material of the first and second connection bands can be the same as that of the parallel bands.

In a variant of the production process, the first and second connection bands are anisotropic conductive ribbons.

Other features and advantages of the invention can be gathered from the following non-limitative description with reference to the drawings, wherein FIG. 1, already described, shows diagrammatically and in perspective a trichromatic screen extrapolated from a monochromatic screen.

FIG. 2, already described, shows diagrammatically a section of a trichromatic screen extrapolated from a monochromatic screen.

FIG. 4A is a top view of the arrangement of conductive bands.

FIG. 4B diagrammatically a connection method between the conductive bands.

Figure 5:
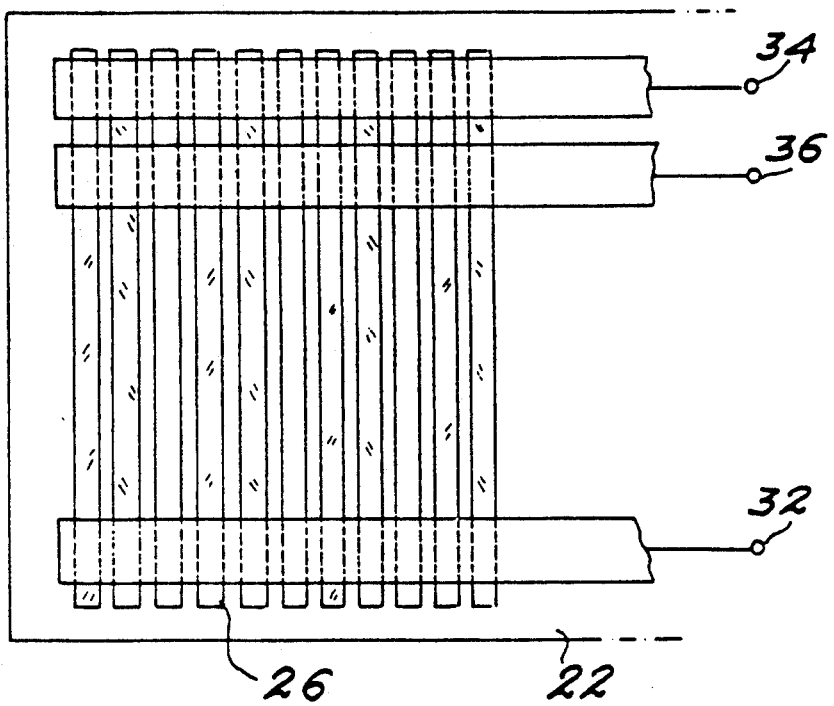

FIG. 5 shows diagrammatically another connection method between the conductive bands.

Figure 6:
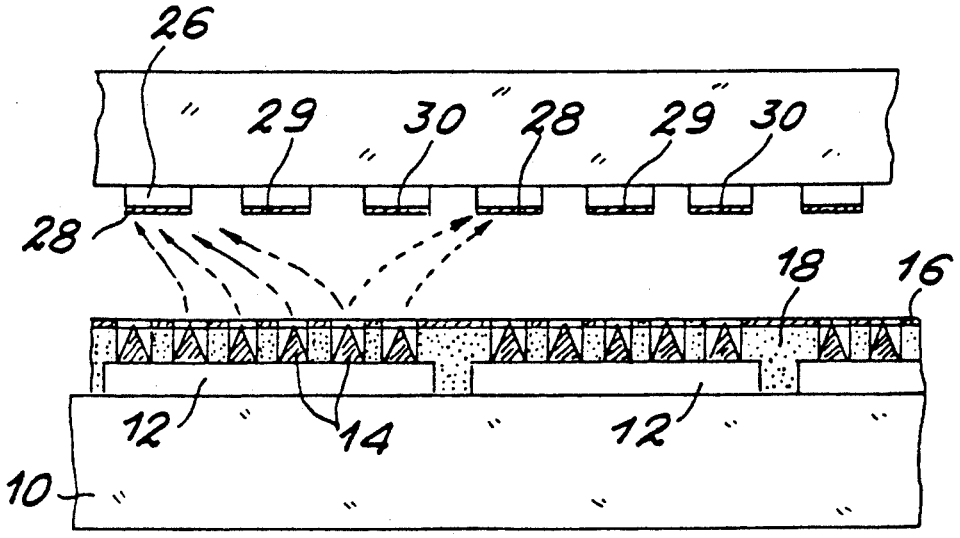

FIG. 6 shows diagrammatically a section of a screen according to the invention.

Figures 7A, 7B, 7C, 7D:
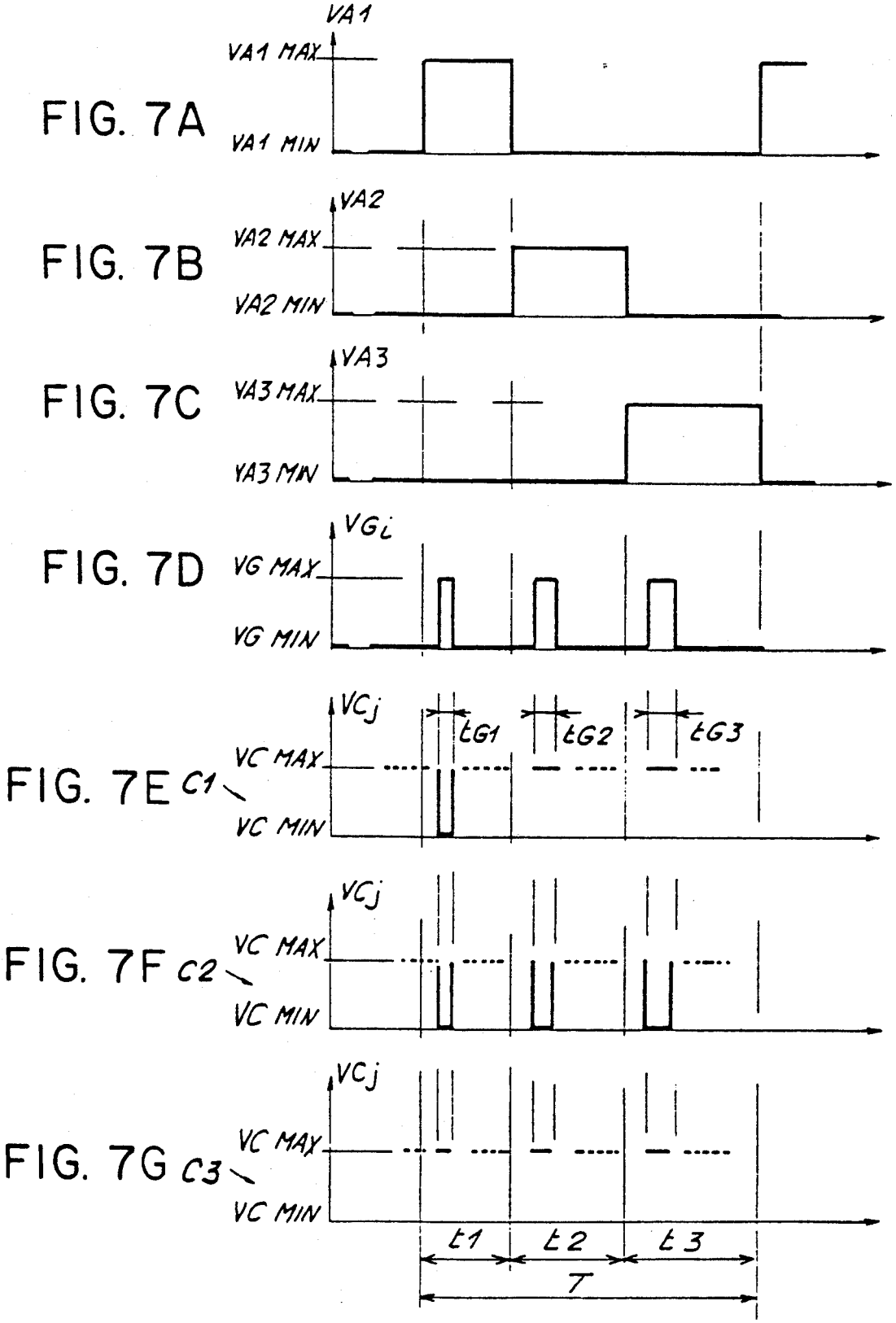

FIGS. 7A to 7C show timing charts relating to a first process for addressing a screen according to the invention.

Figures 8A, 8B, 8C, 8D, 8E, 8F, 8G:
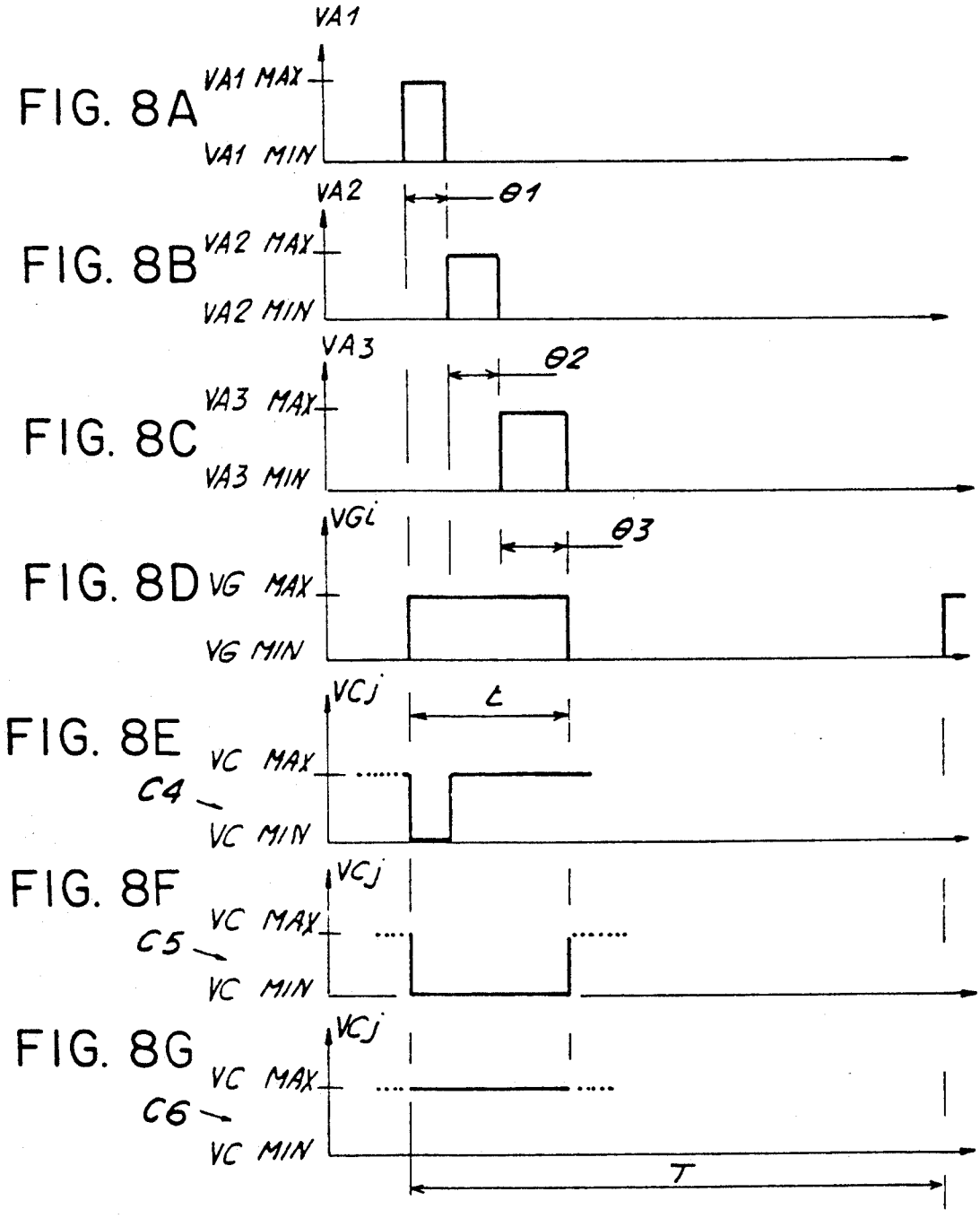

FIGS. 8A to 8C timing charts relating to a second process for addressing a screen according to the invention.

Figure 1:
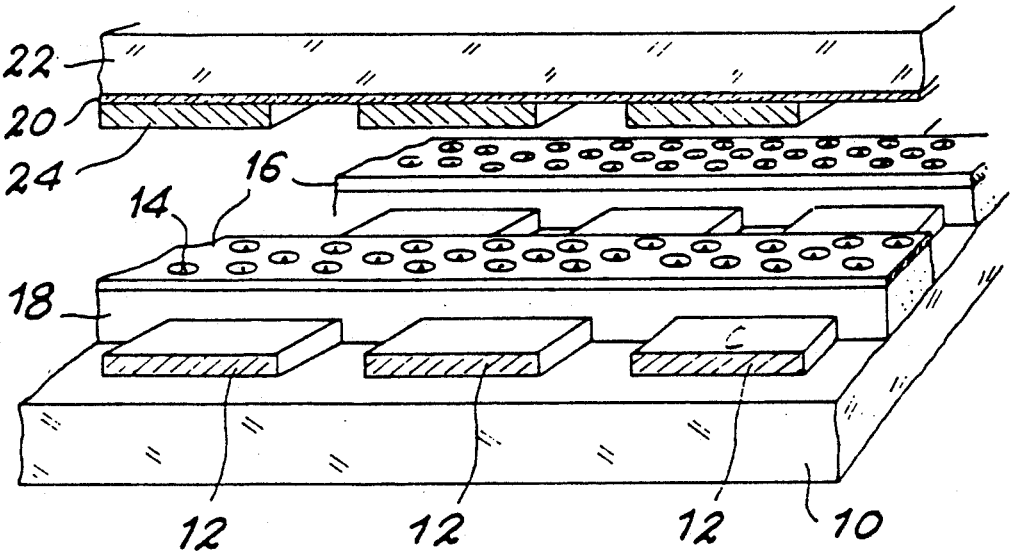
Figure 2:
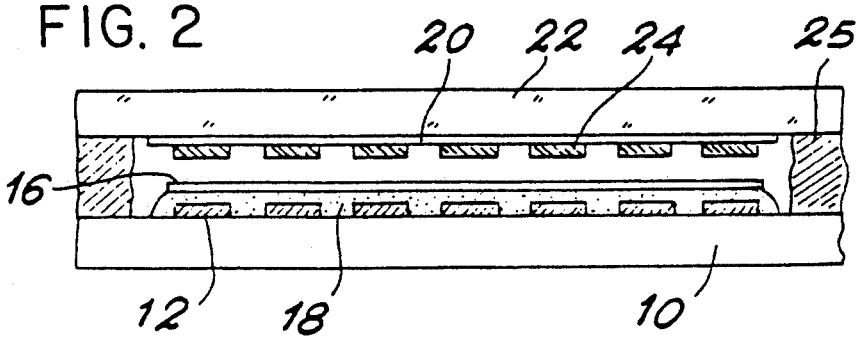
Figure 3:
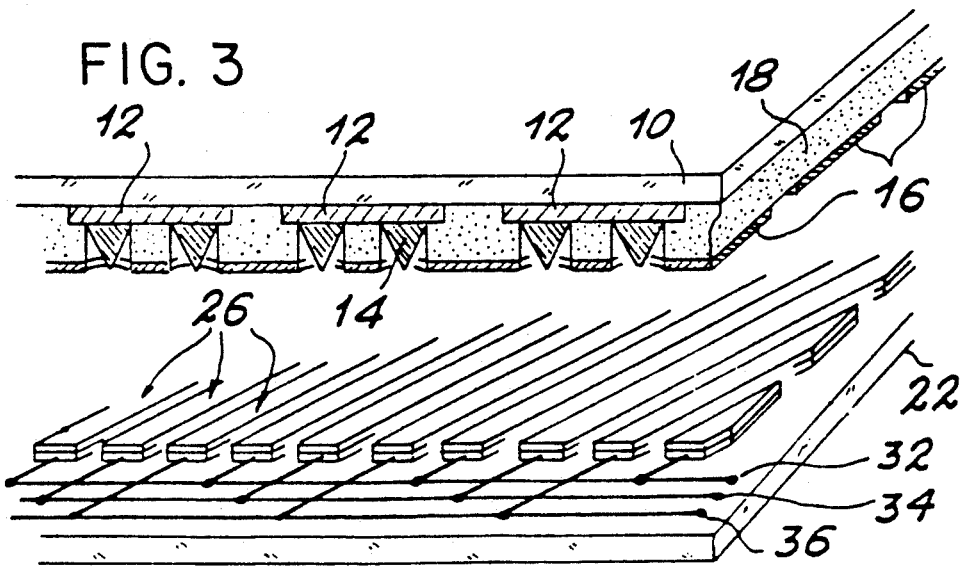
FIG. 3 shows diagrammatically and in perspective a screen according to the invention.

FIG. 3 diagrammatically shows in perspective a screen according to the invention. On a first e.g. glass substrate 10 are provided along the columns cathode conductors 12 of I.T.O. (indium tin oxide), e.g. supporting the microtips 14, along the rows e.g. niobium grids 16 separated from the cathode conductors 12 by an insulating material and e.g. silica layer 18. This first part of the apparatus is identical to that used in the monochromatic screens.

On a second e.g. glass substrate 22 are arranged regularly spaced, parallel conductive bands 26, which are represented diagonally with respect to the direction of the cathode conductors 12 in order to clearly show that no predetermined positioning is required in this type of screen. It is obviously advantageous to place the bands 26 substantially facing the cathode conductors 12 and in a parallel direction. These bands 26 are alternately covered, for a first series of said bands 26, by a material 28 able to emit luminescence in the red, whereby said material 28 can be europium-doped $Y_2O_2S$; for a second series of said bands 26, by a material 29 able to emit luminescence in the green, whereby said material 29 can be CuAL-doped ZnS; and for a third series of said bands 26, by a material 30 able to emit luminescence in the blue, whereby said material 30 can be Ag-doped ZnS.

Preferably, the conductive bands 26 are spaced in such a way that a red, green and blue triplet is superimposed at each intersection of a cathode conductor 12 and a grid 16.

The conductive bands 26 of the first series covered with material 28 are electrically interconnected by a first connection band 32 indicated in FIG. 3 by a connecting wire. This first series of bands 26 corresponds to an anode A1. The conductive bands 26 of the second series covered by material 29 are electrically interconnected by a second connection band 34 indicated in FIG. 3 by a connecting wire. This second series of conductive bands 26 corresponds to an anode A2. The conductive bands 26 of the third series covered by material 30 are electrically interconnected by an anisotropic conductive ribbon or tape 36 indicated in FIG. 3 by a connecting wire. Said third series of conductive bands 26 corresponds to an anode A3.

The spacing between the conductive bands 26 corresponds with the pass band of the video chrominance signal (approximately 150 micrometers for a 1 $dm^2$ screen). The number of cathode conductors 12 corresponds to the pass band of the video luminosity signal (approximately 500 cathode conductors for a pass band of approximately 3 MHz).

FIG. 4A indicates the manner in which the different conductive bands 26 are interconnected in a preferred embodiment. These bands 26 are etched in a conductive material, e.g. I.T.O. covering the substrate 22. For two series of said bands 26, etching simultaneously takes place in the same conductive material of the connection bands 32, 34, each placed at one end of the conductive bands 26. These two series assume the form of combs arranged in head to tail manner. The teeth of one of the combs alternate with those of the other comb and then with the conductive bands 26 of the third series. These conductive bands 26 of the third series are electrically interconnected by an anisotropic conductive ribbon 36, which is deposited perpendicular to the conductive bands 26.

FIG. 4B shows a section of the screen along the anisotropic conductive ribbon 36. The latter is essentially formed by a conductive strip 36'' and a film 36'.

As can be seen in FIG. 4B the conductive strip 36'' crushes the film 36' via extra thicknesses of the strip positioned facing the bands 26 of the third series. The film 36' comprises conductive carbide balls 37 distributed in an insulating binder forming the film 36', so as not to conduct electricity. The density of the balls 37 is such that at the crushed points the balls 37 are in contact, the tape or ribbon becoming conductive at these points. Thus, the conductive bands 26 of the third series are electrically connected to the conductive strip 36'', whereas the non-crushed locations of film 36' are insulating.

As can be seen in FIG. 5, the use of anisotropic conductive ribbons can be extended to the first and second connection bands 32, 34.

FIG. 6 diagrammatically shows a section of a screen according to the invention. During the exciting of a pixel corresponding to the intersection of a cathode conductor 12 and a grid 16, the microtips 14 emit electrons. If anode A1 (respectively A2,A3) corresponding to the conductive bands 26 covered by the material 28 luminescing in the red is addressed, the anodes A2 (or A1,A3) and A3 (or A1,A2) are raised to potentials such that the electrons are repelled. Thus, no matter what the positioning of the conductive bands 26, the "dilution" of the colors due to a parasitic excitation of the anodes A2 (or A1,A3) and A3 (or A1,A2) is avoided. Obviously the phenomenon is the same when anodes A2 and A3 are addressed.

A screen according to the invention makes it possible to reduce by a factor of three the number of control circuits for the cathode conductors 12 compared with the number of such circuits required in the case of a trichromatic screen simply extrapolated from a monochromatic screen. This appreciable gain and this simplification of the control circuitry only requires three additional addressing circuits for the anodes A1, A2 and A3.

Hereinafter are given two non-limitative embodiments of processes for addressing a triple anode screen according to the invention.

First example of addressing signals for the screen according to the invention.

This first addressing method is shown in FIG. 7. According to this first addressing method, a color picture is produced as a result of three successive scans or sweeps of the screen corresponding to three red, green and blue subframes.

The display of a trichromatic frame of the image takes place during a frame time T. The anodes A1, A2 and A3 are respectively raised to potentials VA1, VA2 and VA3. Successively and periodically, potentials VA1, VA2 and VA3 assume values VA1max, VA2max and VA3max adequate for attracting the electrons emitted by the microtips 14 of the cathode conductors 12 corresponding to the pixels which have to be "illuminated" in the color of the considered anode A1, A2 or A3.

Potentials VA1, VA2 and VA3 assume their values VA1max, VA2max and VA3max with a period equal to the frame time T. The latter is divided into three periods t1, t2 and t3 during which the potentials VA1, VA2 and VA3 are maintained at the values VA1max, VA2max and VA3max.

The values VA1max, VA2max and VA3max and the durations t1, t2 and t3 are adapted to the respective efficiencies of the luminescent materials 28,29 and 30. These values are experimentally adjusted in such a way that the saturation of the luminescent materials 28,29,30 gives a pure white when all the pixels of the screen and all the colors are "illuminated", said measure being averaged over several frames of the picture, VA1max, VA2max and VA3max being e.g. approximately 100 V.

In this example of the addressing process, the three periods t1, t2 and t3 correspond to subframes of the picture during which are successively displayed the three monochromatic components red, green and blue of said picture. Outside the periods during which they are raised to VA1max, VA2max and VA3max, the potentials VA1, VA2 and VA3 respectively assume the values VA1min, VA2min and VA3min. These values are such that the electrons emitted by the microtips 14 are repelled by the anodes or received by the anodes with energies below the threshold luminescence energies of the materials 28,29 and 30.

FIG. 7 shows the potential VGi to which the grid i is raised. Periodically VGi assumes the value VGmax equal to e.g. 40 V during the grid selection times tG1, tG2 and tG3. tG1 is the grid selection time during which VGi=VGmax, said addressing taking place during the subframe time t1, tG2 is the grid selection time during which VGi=VGmax, said addressing taking place during the subframe time t2, and tG3 is the grid selection time during which VGi=VGmax during the subframe time t3. Outside these periods tG1, tG2 and tG3, VGi assumes the value VGmin equal to e.g. −40 V. The period of these successive square wave pulses of duration tG1, tG2 and tG3 is equal to a frame time T.

The durations tG1, tG2 and tG3 are related to the durations t1, t2 and t3 as follows.

$$\frac{t1}{tG1} = \frac{t2}{tG2} = \frac{t3}{tG3} = N$$

in which N is equal to the number of lines of the screen.

FIG. 7 gives the control signals VCj of the cathode conductor j making it possible to "illuminate" the pixel ij. These control signals VCj are given in the three following cases:

timing diagram C1: pixel ij illuminated in red;

timing diagram C2: pixel ij illuminated in red, green and blue and pixel ij being "white";

timing diagram C3: pixel ij extinguished and in a "black" state.

For the pixel ij to be "extinguished" (i.e. in a black state), potential VCj assumes a value VCmax equal to e.g. 0 V. In order to "illuminate" the pixel ij (timing diagram C1) in red (respectively green or blue), VCj is raised to a value VCmin equal to e.g. −40 V for the grid selection time tG1 (respectively tG2, tG3).

In order to "illuminate" the pixel ij in the three primary colors red, green and blue (i.e. to obtain a "white" state) (timing diagram C2), potential VCj assumes the value VCmin for the grid selection times tG1, tG2 and tG3 in the three colors. With pixel ij extinguished ("black" state) (timing diagram C3), potential VCj is maintained at the value VCmax for the selection times tG1, tG2 and tG3.

The line or row selection potential VGmax is chosen in such a way that the electron emission is substantially zero when the potential VCmax is applied to the cathode conductor and corresponds to the maximum desired brightness of the screen (e.g. 200 cd/m$^2$), when the potential VCmin is applied to the cathode conductor.

Numerical data corresponding to this example:

| | |
|---|---|
| N | number of lines = 575 |
| T | frame time = 20 ms |
| t1 | selection time of anode A1 (subframe 1) = 6.6 ms |
| t2 | selection time of anode A2 (subframe 2) = 6.6 ms |
| t3 | selection time of anode A3 (subframe 3) = 6.6 ms |
| tG1 | selection time of a line during subframe 1 = 11 μs |
| tG2 | selection time of a line during subframe 2 = 11 μs |
| tG3 | selection time of a line during subframe 3 = 11 μs |
| VA1 | potential of anode A1 = VA1max = 100V, VA1min = 40V |
| VA2 | potential of anode A2 = VA2max = 100V, VA2min = 40V |
| VA3 | potential of anode A3 = VA3max = 150V, VA3min = 40V |
| VGi | potential of grid i = VGmax = 40V, VGmin = −40V |
| VCj | potential of cathode conductor j = VCmax = 0V, VCmin = −40V. |

Second example of signals for addressing the screen according to the invention.

This second addressing method is shown in FIG. 8 and according to it a color picture is produced through the writing of each of the three primary color red, green and blue row by row. Conventionally, each row i (grid) is addressed for a grid selection time t, i.e. at the period T of the frame time, the potential VGi assuming the value VGmax for a duration T and otherwise VGi being equal to VGmin.

The anodes A1, A2 and A3 are raised respectively to potentials VA1, VA2 and VA3. Periodically (at period t, row selection time), VA1, VA2 and VA3 successively assume the values VA1max, VA2max and VA3max for respective times θ1, θ2 and θ3. They otherwise assume the values VA1min, VA2min and VA3min. The duration θ1, θ2 and θ3 are linked with the grid selection time t by the relation:

$$t = \theta 1 + \theta 2 + \theta 3$$

Obviously the grid selection time is linked with the frame time T by the relation:

$$t = \frac{T}{N}$$

in which N is the number of lines of the screen.

FIG. 8 also shows the control signals VCj of the cathode conductor j making it possible to "illuminate" the pixel ij, which is "extinguished" ("black" state), potential VCj assuming a value VCmax equal to e.g. 0 V.

The control signals VCj are given in the three following cases:

Timing diagram C4: pixel ij illuminated in red

Timing diagram C5: pixel ij illuminated in red, green and blue and pixel ij "white"

Timing diagram C6: pixel ij extinguished and "black".

The timing diagram C4 describes the potential VCj during the addressing of the cathode conductor j making it possible to "illuminate" pixel ij in red (respectively green or blue). For duration θ1 (respectively θ2, θ3) for the addressing of the red anode A1 (respectively green A2 or blue A3), VCj assumes the value VCmin, VCj being equal to VCmax for the remainder of the selection time of row i.

Timing diagram C5 describes the potential VCj during the addressing of the cathode conductor j making it possible to "illuminate" pixel ij in red, green and blue, i.e. obtain a "white" state for pixel ij. In this case, VCj is raised to VCmin for the complete selection time t of row i.

Timing diagram C6 describes the potential VCj during the addressing of the cathode conductor j in the case where pixel ij is "extinguished". In this case VCj is maintained at the value VCmax for the selection time t of row i.

Numerical data corresponding to this example:

| | |
|---|---|
| N | number of lines = 575 |
| T | frame time = 20 ms |
| t | selection time of a row (grid) 33 μs |
| θ1 | selection time of anode A1 = 11 μs |
| θ2 | selection time of anode A2 = 11 μs |
| θ3 | selection time of anode A3 = 11 μs |
| VA1 | potential of anode A1 = VA1max = 100V, VA1min = 40V |
| VA2 | potential of anode A2 = VA2max = 100V, VA2min = 40V |
| VA3 | potential of anode A3 = VA3max = 150V, VA3min = 40V |
| VGi | potential of grid i = VGmax = 40V, VGmin = −40V |
| VCj | potential of cathode conductor j = VCmax = OV, VCmin = −40V. |

I claim:

1. Process for addressing a matrix display microtip trichromatic fluorescent screen having a first substrate on which are arranged, in two directions of the matrix, conductor columns forming cathode conductors and supporting microtips and above the columns perforated conductive rows forming grids, the rows and columns being separated by an insulating layer having apertures permitting the passage of the microtips, each intersection of a row and a column corresponding to a pixel, said screen having on a second substrate facing the first, parallel, regularly spaced conductive bands, which are alternately covered by a material luminescing in the red forming a red anode, a material luminescing in the green forming a green anode and a material luminescing in the blue forming a blue anode, the conductive bands covered with the same luminescent material being electrically interconnected;

said conductive bands being spaced in such a way that each intersection of said row and said column is facing three conductive bands, one conductive band covered by said material luminescing in red, one conductive band covered by said material luminescing in the green and one conductive band covered by said material luminescing in the blue;

said process comprising the step of raising successively and periodically said red, green and blue anodes $A_i$, with i ranging from 1 to 3, during respective preselected times to a potential VAi max adequate for attracting electrons emitted by microtips of said cathode conductors corresponding to the pixels having to be "illuminated" in the color of the respective anode, maintaining said respective anodes at all other times at a potential VAi min in such way that no light is produced, this VAi min repelling said electrons or being such that said electrons have an energy below the threshold cathodoluminescence energy of the luminescent material covering the anodes Ai, selectively energizing said cathode conductors and supporting microdots and said grids for exciting individual pixels as a result of the common energizing of a selected anode, grid and cathode.

2. Addressing process according to claim 1, the addressing of a trichromatic frame of the picture taking place during a frame time T, wherein the anodes Ai are raised to the potential VAimax for a period equal to the frame time T, which is subdivided into three periods t1, t2 and t3 corresponding to the times during which the anodes A1, A2 and A3 are raised to the potentials VA1max, VA2max and VA3max.

3. Addressing process according to claim 1, the display of a trichromatic frame of the picture taking place by sequentially addressing each grid conductor row for a selection time t, wherein the anodes Ai are raised to the potential VAimax for a period equal to the selection time t, which is subdivided into three periods $\theta 1$, $\theta 2$ and $\theta 3$ corresponding to the times during which the anodes A1, A2 and A3 are raised to the potentials VA1max, VA2max and VA3max.

4. Process for the production of a microtip trichromatic fluorescent screen according to claim 1 the second substrate (22) being covered with a conductive material, characterized in that it comprises etching in said material regularly spaced, parallel bands (26), which are alternately grouped into three series, a first series of bands (26) being electrically connected by a first conductive material connection band (32), which is perpendicular to the parallel bands (26) and is placed at one of the ends thereof, a second series of the parallel bands (26) being electrically connected by a second conductive material connection band (34), which is perpendicular to the parallel bands (26) and is placed at the other of the ends thereof, electrically connecting the third series of parallel bands (26) by an anisotropic conductive ribbon (36) and covering one series of parallel bands (26) by a material (28) able to emit luminescence in the red, a second series of parallel bands (26) by a material (29) able to emit luminescence in the blue and the final series of parallel bands by a material (30) able to emit luminescence in the green.

5. Process according to claim 1 for addressing said matrix display microtip trichromatic fluorescent screen further comprising the steps of:

energizing a set of common anodes for a red color to a potential VA1 max during a time period $t_1$ which is substantially one third of a frame time period T;

energizing a set of common anodes for a green color to a potential VA2 max during a time period $t_2$ which is substantially one third of said time period T;

energizing a set of common anodes for a blue color to a potential VA3 max during a time period $t_3$ which is substantially one third of said time period T;

energizing sequentially each grid of said trichromatic fluorescent screen to $V_g$max during said respective time frames $t_1$, $t_2$, and $t_3$;

exciting particular pixels of said matrix display microdot fluorescent screen by the energization of the cathode conductor of said particular pixel;

thus producing illumination of said particular pixel in the color of the common anode upon the coincidental energization of said common anode, said grid and said cathode of said particular pixel.

6. Process according to claim 1 for addressing said matrix display microtip trichromatic fluorescent screen further comprising the steps of:

energizing each selected grid of said trichromatic fluorescent screen to Vg max during a selection time t;

energizing a set of common anodes for a red color to a potential VA1 max during a time period $\theta 1$ which is substantially one third of t;

energizing a set of common anodes for a green color to a potential VA2 max during a time period $\theta 2$ which is substantially one third of t;

energizing a set of common anodes for a blue color to a potential VA3 max during a time period $\theta 3$ which is substantially one third of t;

exciting particular pixels of said matrix display microtip fluorescent screen by the energization of the cathode conductor of said particular pixel;

thus producing illumination of said particular pixel in the color of said common anode upon the coincidental energization of said common anode, said grid and said cathode of said particular pixel.

7. A matrix display microtip trichromatic fluorescent screen having a first substrate on which are arranged in two directions of the matrix, conductive columns forming cathode conductors and supporting microtips and above said columns perforated conductive rows, said columns intersect perforated conductive rows that act as grids for excitation of said microtips;

said rows and columns being separated by an insulating layer having apertures permitting the passage of the microdots, wherein each intersection of a row and a column corresponds to a pixel, said screen having on a second substrate facing said first, parallel, regularly spaced conductive bands, which are alternatively covered by a material luminescing in the red forming a red anode, a material luminescing in the green forming a green anode and a material luminescing in the blue forming a blue anode, said conductive bands covered with the same luminescent material being electrically interconnected;

said conductive bands being spaced in such a way that each intersection of said row and said column is facing three conductive bands, one conductive band covered by said material luminescing in red, one conductive band covered by said material luminescing in the green and one conductive band covered by said material luminescing in the blue;

said matrix comprising means for raising successively and periodically said red, green and blue anodes $A_i$, with i ranging from 1 to 3, during respective preselected times to a potential VAi max adequate for attracting electrons emitted by microtips of said cathode conductors corresponding to the pixels having to be "illuminated" in the color of the respective anode, means for maintaining said respective anodes at all other times at a potential VAi min in such way that no light is produced, this VAi min repelling said electrons or being such that said electrons have an energy below the threshold cathodoluminescence energy of the luminescent material covering the anodes Ai, means for selectively energizing said cathode conductors and supporting microdots and said grids for exciting individual pixels as a result of the common energizing of a selected anode, grid and cathode;

wherein illumination of a particular pixel in one of the colors of the anodes results from the coincidental energization of a conductive column acting as a cathode, a perforated conductive row acting as a grid and a conductive band acting as an anode for the color to be produced.

* * * * *